US006572214B2

(12) United States Patent
Otis, Jr. et al.

(10) Patent No.: US 6,572,214 B2
(45) Date of Patent: Jun. 3, 2003

(54) INKJET PRINTING SYSTEMS USING FILTER FLUID INTERCONNECTS FOR PIGMENTED INKS

(75) Inventors: David R. Otis, Jr., Corvallis; Daniel W. Petersen, Philomath; Donald L. Michael, Monmouth, all of OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 09/803,398

(22) Filed: Mar. 9, 2001

(65) Prior Publication Data

US 2002/0126188 A1 Sep. 12, 2002

(51) Int. Cl.[7] ..... B41J 2/20
(52) U.S. Cl. ..... 347/23; 347/85
(58) Field of Search ..... 347/28, 85, 86, 347/87, 92, 93; 210/446

(56) References Cited

U.S. PATENT DOCUMENTS

| | | | | |
|---|---|---|---|---|
| 3,856,555 A | * | 12/1974 | Mandeville | 427/378 |
| 4,272,773 A | | 6/1981 | Halasz | 346/140 R |
| 4,719,479 A | * | 1/1988 | Kyogoku | 347/93 |
| 5,124,717 A | * | 6/1992 | Campanelli et al. | 347/93 |
| 5,428,377 A | | 6/1995 | Stoffel et al. | 347/15 |
| 5,481,289 A | * | 1/1996 | Arashima et al. | 347/93 |
| 5,489,930 A | | 2/1996 | Anderson | 347/71 |
| 5,495,272 A | * | 2/1996 | Yamaguchi | 347/28 |
| 5,537,136 A | | 7/1996 | Brandon et al. | 347/87 |
| 5,610,645 A | | 3/1997 | Moore et al. | 347/93 |
| 5,657,065 A | | 8/1997 | Lin | 347/93 |
| 5,705,070 A | * | 1/1998 | Saaski et al. | 210/446 |
| 5,771,052 A | | 6/1998 | Hine et al. | 347/42 |
| 5,969,739 A | * | 10/1999 | Altendorf et al. | 347/87 |
| 6,000,789 A | | 12/1999 | Takagi et al. | 347/86 |
| 6,042,225 A | | 3/2000 | Altendorf et al. | 347/87 |
| 6,084,618 A | | 7/2000 | Baker | 347/93 |

FOREIGN PATENT DOCUMENTS

EP 0645244 A1 3/1995

OTHER PUBLICATIONS

International Search Report for PCT International Application No. PCT/US02/03830 mailed Jun. 19, 2002. (7 pgs.).

* cited by examiner

*Primary Examiner*—Anh T. N. Vo
(74) *Attorney, Agent, or Firm*—Kevin B. Sullivan

(57) ABSTRACT

Disclosed is a pigmented fluid delivery system for an inkjet printing system. The pigmented fluid delivery system comprises a first printer component and at least a second printer component. The first printer component has a fluid outlet in fluid communication with a supply of pigmented fluid defined by particles suspended in a carrier fluid. The second printer component has a fluid inlet releasably connectable to the fluid outlet of the first printer component. The fluid inlet includes a filter compatible with the supply of pigmented fluid. The filter is an open weave screen defining a plurality of pores. The pores are sized to allow passage of the pigmented fluid while preventing clogging from flocculation of the particles and evaporation of the carrier fluid.

30 Claims, 5 Drawing Sheets

INKJET PRINTING SYSTEMS USING FILTER FLUID INTERCONNECTS FOR PIGMENTED INKS

TECHNICAL FIELD

This invention relates to inkjet printing systems. In particular, the present invention is a pigmented ink delivery system that employs filter fluid interconnects to fluidly interconnect separable ink delivery system components. The filter fluid interconnects function to provide reliable fluid interconnects between ink delivery system components, such as ink supply containers, inkjet printheads and ink manifold structures of an ink container receiving station. The screen filter fluid interconnects also prevent drooling of ink when ink delivery system components are separated, prevent clogging of the pigmented ink delivery system, and impede the passage of debris and air bubbles from the ink supply containers to the printheads.

BACKGROUND OF THE INVENTION

Throughout the business world, inkjet printing systems are extensively used for image reproduction. Inkjet printers frequently make use of an inkjet printhead mounted within a carriage that is moved back and forth across print media, such as paper. As the printhead is moved relative to the print media, a control system activates the printhead to deposit or eject ink droplets onto the print media to form images and text. Such systems may be used in a wide variety of applications, including computer printers, plotters, copiers and facsimile machines.

Ink is provided to the printhead by a supply of ink that is either integral with the printhead, as in the case of a disposable print cartridge, or by a supply of ink that is replaceable separate from the printhead. One type of previously used printing system makes use of an ink supply that is carried with the carriage. This ink supply has been formed integral with the printhead, whereupon the entire printhead and ink supply are replaced when ink is exhausted. Alternatively, the ink supply can be carried with the carriage and be separately replaceable from the printhead. As a further alternative, the ink supply can be mounted to the printing system such that the ink supply does not move with the carriage. For the case where the ink supply is not carried with the carriage, the ink supply can be in fluid communication with the printhead to replenish the printhead or the printhead can be intermittently connected with the ink supply by positioning the printhead proximate to a filling station to which the ink supply is connected whereupon the printhead is replenished with ink from the refilling station. Generally, when the ink supply is separately replaceable, the ink supply is replaced when exhausted. The printhead is then replaced at the end of printhead life. Regardless of where the ink supply is located within the printing system, it is critical that the ink supply provides a reliable supply of ink to the inkjet printhead.

Inkjet printing systems typically employ either dye based inks or pigmented inks. In dye based inks, the ink color is in solution and defines the ink itself. As such, dye based inks readily remain in solution. In pigmented inks, the ink color is defined by particles suspended in a carrier fluid. As such, in pigmented inks, the ink color particles can fall out of suspension (i.e., flocculate) or the carrier fluid can evaporate off leaving the ink color particles behind. These conditions are not as pronounced in dye based inks, since dye based inks easily remain in solution, and if the ink color of dye based inks does settle out, the ink color readily goes back in suspension. In ink delivery systems that use dye based inks, a fluid interconnect, employing a fluid delivery tower having a filter, is used to fluidically couple separable ink delivery components, such as ink containers, printheads and a carriage manifold.

The filter of the filter/tower fluid interconnect allows passage of the dye based ink when the ink delivery system is operating, and prevents ink drooling when the ink delivery components are disconnected. In addition, the filter of the filter/tower fluid interconnect can impede the passage of air bubbles and particulate matter to the ink delivery tower and ultimately to the print element of the printhead. If bubbles and particulate matter enters the print element, they can block the ink delivery channels, conduits, chambers, orifices and ink ejection nozzles of the print element, thereby adversely affecting printhead performance. This clogging is likely to result in one or more inoperable firing chambers within the printhead, which would require that the clogged printhead, be replaced with a new printhead before the useful life of the clogged printhead is exhausted. From the perspective of cost, this course of action is undesirable. In addition to providing filtering benefits, the filter/tower fluid interconnects used with dye based inks are economical to manufacture.

In pigmented ink delivery systems, flocculation and evaporation of carrier fluid becomes a particular problem when a user disconnects the separable ink supply containers and/or printheads from the carriage manifold. At this time, fluid interconnects between the ink containers, printheads and carriage manifold are exposed to the atmosphere, and the carrier fluid at the fluid interconnects can quickly evaporate off leaving behind ink color particles that may clog these fluid interconnects. In addition to evaporative based clogging, if the containers, printheads and carriage remain in a sedentary state for too long, the ink color particles can settle out of the carrier fluid also resulting in clogging of the fluid interconnects. As such, ink delivery systems that use pigmented inks, do not use filter/tower fluid interconnects since the filter can become easily clogged upon evaporation of the carrier fluid or when the ink color particles settle out of the carrier fluid. Moreover, ink delivery channels associated with the fluid interconnect can become clogged with pigmented ink viscous plugs due to liquid bridging. Therefore ink delivery systems for pigmented inks typically employ higher cost (when compared to filter/tower fluid interconnects) needle/septum fluid interconnects that can easily dislodge or break up pigmented ink clogs as the needle pierces the septum.

There is a need for improved fluid interconnects for components of ink delivery systems. In particular, there is a need for a filter/tower fluid interconnect that is not susceptible to pigmented ink clogs caused by the ink color particles falling out of suspension (i.e., flocculation) or the carrier fluid evaporating off leaving the ink color particles behind. Moreover, ink delivery channels associated with the filter/tower fluid interconnect should not be susceptible to clogging caused by pigmented ink viscous plugs as a result of liquid bridging. In addition, the filter/tower fluid interconnect should prevent pigmented ink drooling (i.e., leakage) at ink outlets and inlets when separable ink supply containers and printheads are disconnected from a carriage manifold. Further, the filter/tower fluid interconnect should impede debris and air bubbles from clogging or otherwise restricting the flow of pigmented ink from an ink reservoir of an ink container to a print element of a printhead. The filter/tower fluid interconnect should reliably provide these features throughout the useful life of the pigmented ink delivery system components so as to preclude premature replacement of these components and the associated cost. Lastly, the filter/tower fluid interconnect should be relatively easy and inexpensive to manufacture, and relatively simple to incorporate into components used in pigmented ink delivery systems of thermal inkjet printing systems.

SUMMARY OF THE INVENTION

The present invention is a pigmented fluid delivery system. The pigmented fluid delivery system comprises a first component and a second component. The first component has a fluid outlet in fluid communication with a supply of pigmented fluid. The second component has a fluid inlet releasably connectable to the fluid outlet of the first component. The fluid inlet includes a filter compatible with the supply of pigmented fluid.

In one aspect of the present invention, the pigmented fluid is defined by particles suspended in a carrier fluid, and the filter is an open weave screen defining a plurality of pores. The pores are sized to allow passage of the pigmented fluid while preventing clogging from flocculation of the particles and evaporation of the carrier fluid. In addition, the pores are sized to retain pigmented ink (i.e., prevent drooling) when the first and second components are disconnected. In a further aspect of the present invention, each pore of the plurality of pores has an edge-to-edge dimension of 200 $\mu$m, and a depth dimension of 170 $\mu$m which is perpendicular to the edge-to-edge dimension. In another aspect of the present invention, each pore of the plurality of pores has an edge-to-edge dimension of 106 $\mu$m, and a depth dimension of 70 $\mu$m which is perpendicular to the edge-to-edge dimension. In still another aspect of the present invention, the fluid inlet of the second component includes a cylindrical tower having an upstream end to which the filter is mounted and an opposite downstream end. A cylindrical channel extends perpendicular to the tower, and is in fluid communication with the downstream end of the tower. The channel has a diameter of 2.0 mm. In still a further aspect of the present invention, the first component is a replaceable fluid container, and the second component is a replaceable printhead. In yet another aspect of the present invention, the ink delivery system includes a third component having a fluid inlet releasably connectable to a fluid outlet of the second component. The fluid inlet of the third component includes a filter compatible with the supply of pigmented fluid. In this aspect of the present invention, the first component is a replaceable fluid container including a reservoir containing the supply of pigmented fluid, the second component is a manifold adapted to removably receive the replaceable fluid container, and the third component is a replaceable printhead adapted to be removably received by the manifold.

In another embodiment, the present invention provides a fluid interconnect. The fluid interconnect includes a tower member adapted to be connectable to a supply of pigmented fluid defined by particles suspended in a carrier liquid. A screen is mounted to the tower member. The screen defines a plurality of pores sized to allow passage of pigmented fluid from the supply of pigmented fluid, and sized so as to prevent clogging due to flocculation of the particles and evaporation of the carrier fluid.

In a further embodiment, the present invention provides a printer component. The printer component comprises a housing that includes a fluid inlet. The fluid inlet is releasably connectable to a supply of pigmented fluid. The fluid inlet includes a filter defining a plurality of pores sized to allow passage of pigmented fluid from the supply of pigmented fluid, and sized so as to prevent clogging due to flocculation of the particles and evaporation of the carrier fluid.

The filter/tower fluid interconnect of the present invention is not susceptible to pigmented ink clogs caused by the ink color particles falling out of suspension (i.e., flocculation) or the carrier fluid evaporating off leaving the ink color particles behind. Moreover, the ink delivery channel associated with the screen filter/tower fluid interconnect is not susceptible to clogging caused by pigmented ink viscous plugs as a result of liquid bridging. In addition, the filter/tower fluid interconnect of the present invention substantially prevents pigmented ink drooling (i.e., leakage) when the separable ink delivery components are disconnected. Moreover, the filter/tower fluid interconnect of the present invention impedes debris and air bubbles from clogging or otherwise restricting the flow of pigmented ink from an ink reservoir of an ink container to a print element of a printhead. The filter/tower fluid interconnect of the present invention reliably provides these features throughout the useful life of the pigmented ink delivery system components so as to preclude premature replacement of these components and the associated cost. Lastly, the filter/tower fluid interconnect of the present invention is relatively easy and inexpensive to manufacture, and relatively simple to incorporate into components used in pigmented ink delivery systems of thermal inkjet printing systems.

BRIEF DESCRIPTION OF THE DRAWINGS

The accompanying drawings are included to provide a further understanding of the present invention and are incorporated in and constitute a part of this specification. The drawings illustrate the embodiments of the present invention and together with the description serve to explain the principles of the invention. Other embodiments of the present invention and many of the intended advantages of the present invention will be readily appreciated as the same become better understood by reference to the following detailed description when considered in connection with the accompanying drawings, in which like reference numerals designate like parts throughout the figures thereof, and wherein.

DETAILED DESCRIPTION OF THE PREFERRED EMBODIMENTS

Figure 1:
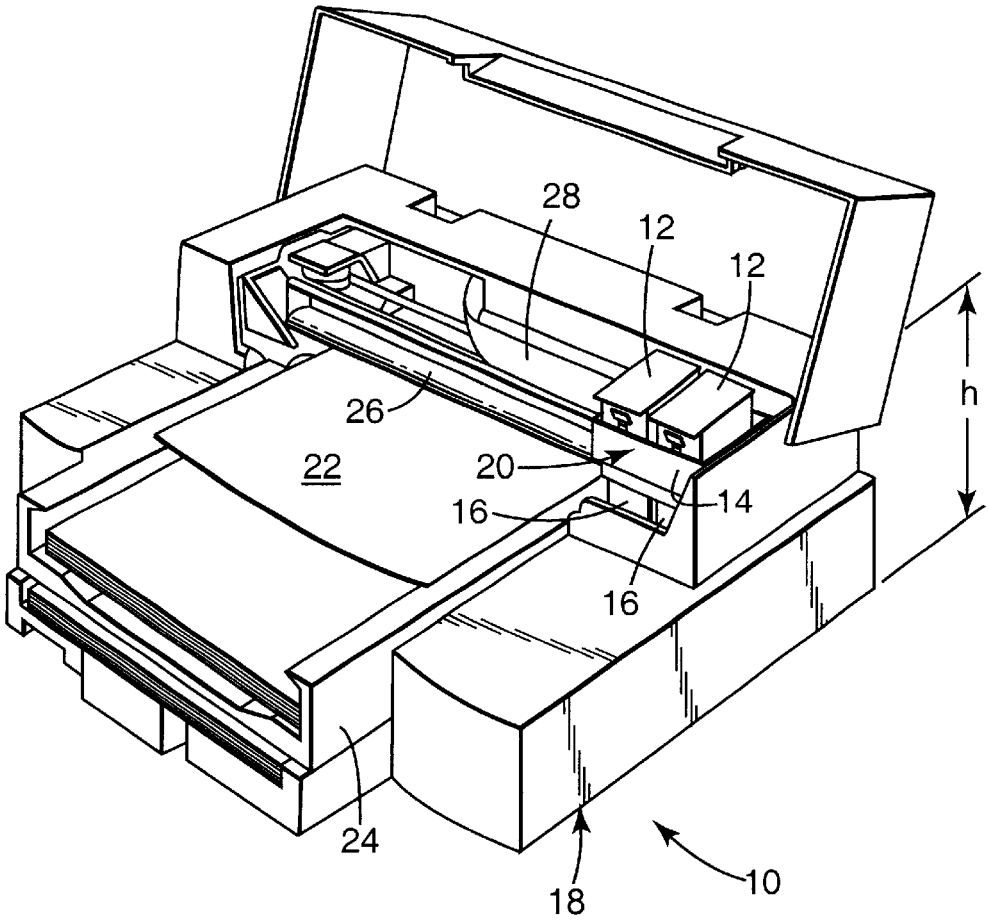
FIG. 1 is a perspective view of a thermal inkjet printing system with a cover opened to show a plurality of replaceable ink containers, a receiving station, and a plurality of replaceable inkjet printhead cartridges incorporating filter fluid interconnects in accordance with the present invention.
Figure 2:
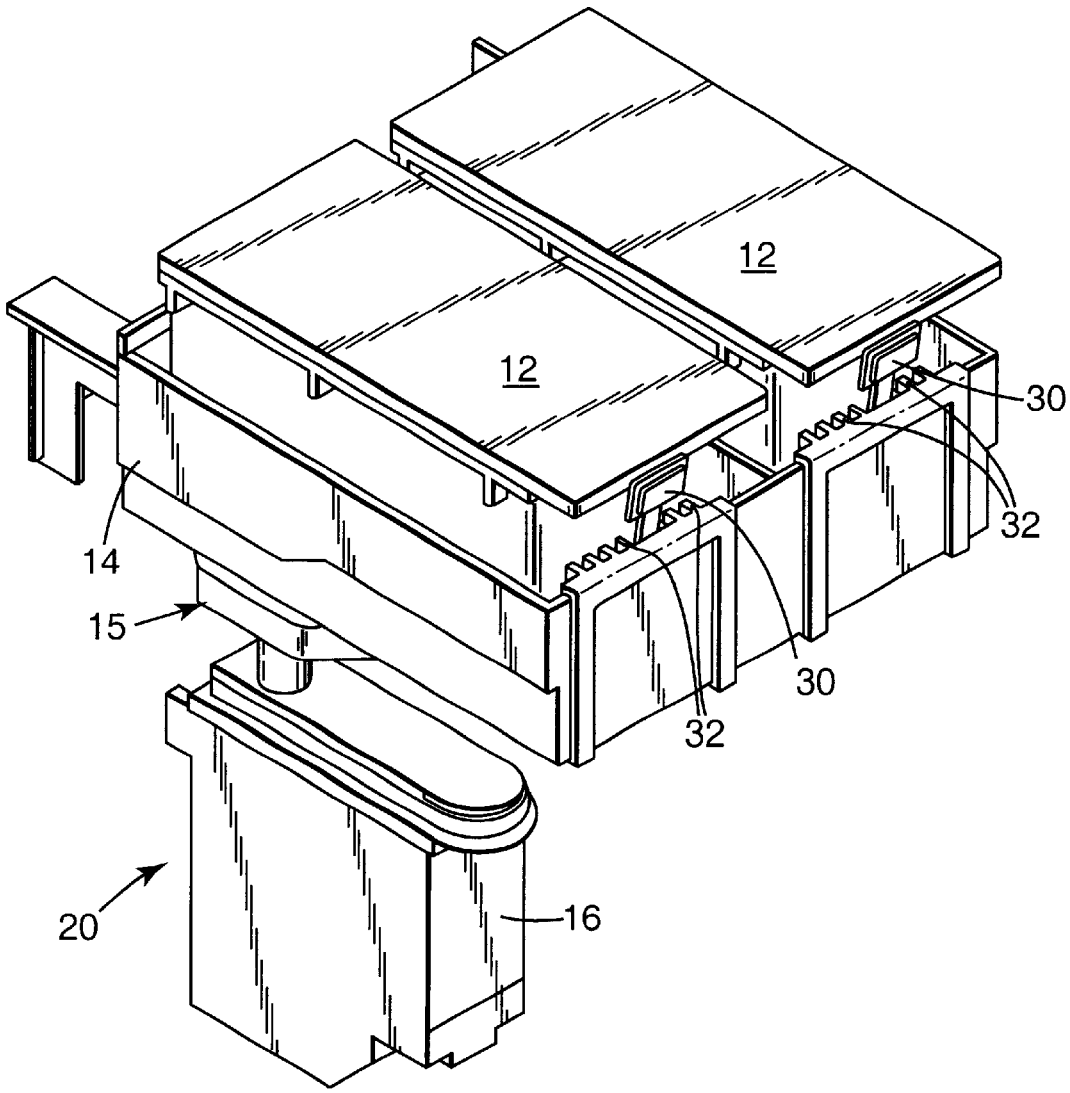
FIG. 2 is a perspective view a portion of a scanning carriage showing the replaceable ink containers positioned in the receiving station which includes a manifold that provides fluid communication between the replaceable ink containers and one or more printhead cartridges.
Figure 3:
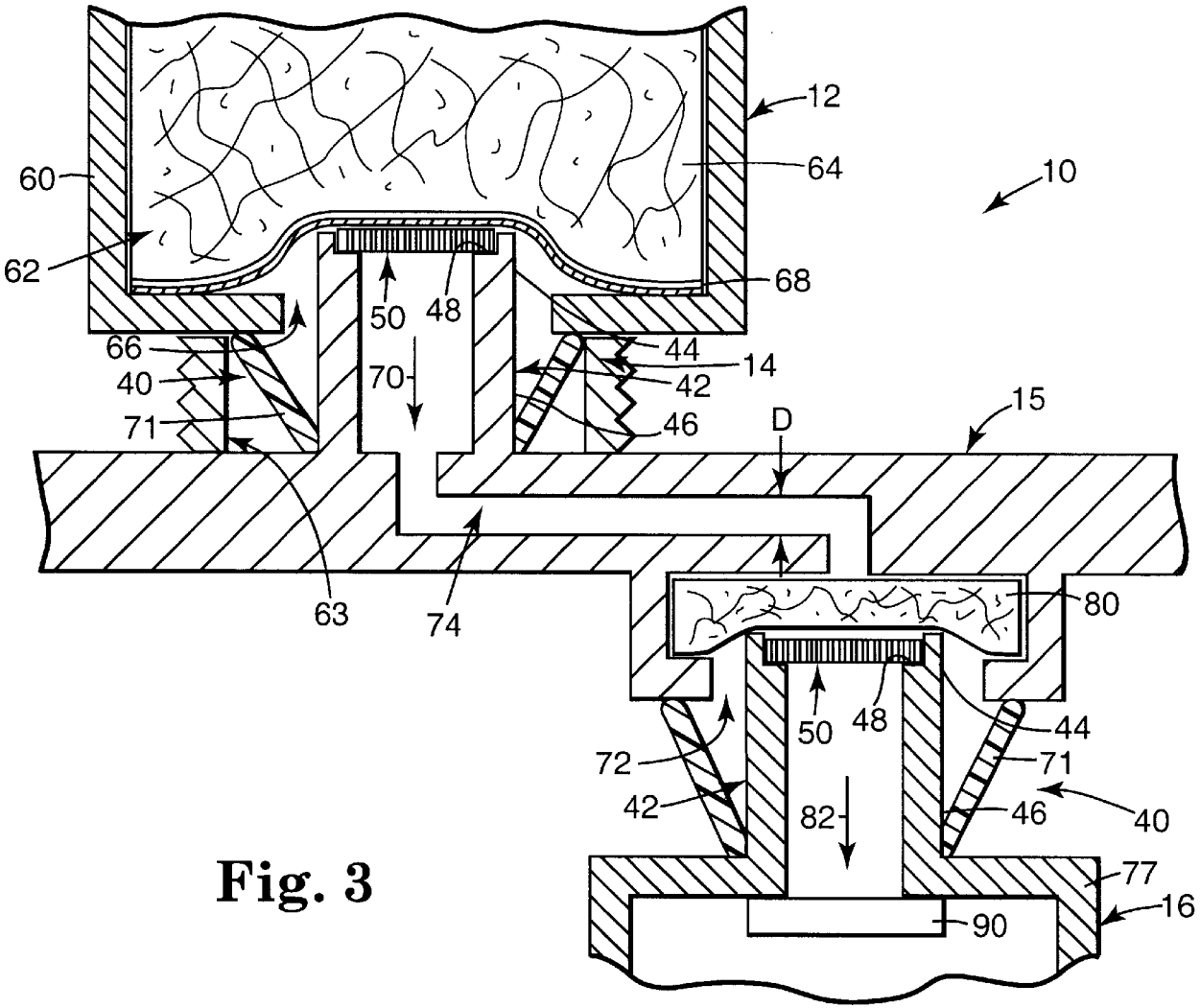
FIG. 3 is a partial sectional view illustrating a replaceable ink container and a replaceable printhead cartridge in fluidically coupled with the manifold using the filter fluid interconnects in accordance with the present invention.

Filter fluid interconnects 40 (see FIG. 3) in accordance with the present invention are useable to fluidically couple a replaceable fluid container 12, a manifold 15 on a receiving station 14, and a printhead cartridge 16 of a thermal inkjet printing system 10 generally illustrated in FIGS. 1–3.

In FIG. 1, the printing system 10, shown with its cover open, includes at least one replaceable fluid container 12 that is installed in a receiving station 14. In one preferred embodiment, the printing system 10 includes two replaceable fluid containers 12, with one single color fluid container 12 containing a black ink supply, and one multi-color fluid container 12 containing cyan, magenta and yellow pigmented ink supplies. With the replaceable fluid containers 12 properly installed into the receiving station 14, pigmented fluid, such as pigmented ink, is provided from the replaceable fluid containers 12 to at least one inkjet printhead cartridge 16 by way of a manifold 15 (see FIGS. 2 and 3) on the receiving station 14. The pigmented ink is defined by ink color particles suspended in a carrier fluid. Generally, the printing system 10 includes at least two replaceable printhead cartridges 16, such as one single color printhead cartridge 16 for printing from the black pigmented ink supply, and one multicolor printhead cartridge 16 for printing from the cyan, magenta and yellow pigmented ink supplies. In one preferred embodiment, the printing system 10 includes four replaceable printhead cartridges 16, such that one printhead cartridge 16 is used for printing from each of the black, cyan, magenta and yellow pigmented ink supplies.

In operation, the inkjet printhead cartridges 16 are responsive to activation signals from a printer portion 18 to deposit pigmented fluid on print media 22. As pigmented fluid is ejected from the printhead cartridges 16, the printhead cartridges 16 are replenished with pigmented fluid from the fluid containers 12. In one preferred embodiment, the replaceable fluid containers 12, receiving station 14, manifold 15, and the replaceable inkjet printhead cartridges 16 are each part of a scanning carriage 20 that is moved relative to the print media 22 to accomplish printing. The printer portion 18 includes a media tray 24 for receiving the print media 22. As the print media 22 is stepped through a print zone, the scanning carriage 20 moves the printhead cartridges 16 relative to the print media 22. The printer portion 18 selectively activates the printhead cartridges 16 to deposit pigmented fluid on print media 22 to thereby accomplish printing.

The scanning carriage 20 of FIG. 1 slides along a slide rod 26 to print along a width of the print media 22. A positioning means (not shown) is used for precisely positioning the scanning carriage 20. In addition, a paper advance mechanism (not shown) moves the print media 22 through a print zone as the scanning carriage 20 is moved along the slide rod 26. Electrical signals are provided to the scanning carriage 20 for selectively activating the printhead cartridges 16 by means of an electrical link, such as a ribbon cable 28.

FIG. 2 is a perspective view of a portion of the scanning carriage 20 showing the pair of replaceable fluid containers 12 properly installed in the receiving station 14. For clarity, only a single inkjet printhead cartridge 16 is shown in fluid communication with the manifold 15 of the receiving station 14. As seen in FIG. 2, each of the replaceable fluid containers 12 includes a latch 30 for securing the replaceable fluid container 12 to the receiving station 14. In addition, the receiving station 14 includes a set of keys 32 that interact with corresponding keying features (not shown) on the replaceable fluid containers 12. The keying features on the replaceable fluid containers 12 interact with the keys 32 on the receiving station 14 to ensure that the replaceable fluid containers 12 are compatible with the receiving station 14.

FIG. 3 illustrates the manifold 15 of the receiving station 14 which includes a fluid inlet or filter fluid interconnect 40 in accordance with the present invention, and further illustrates the replaceable printhead cartridge 16 which also includes a fluid inlet or filter fluid interconnect 40 in accordance with the present invention. The filter fluid interconnects 40 of the manifold 15 and the printhead cartridge 16 are substantially similar, so only the filter fluid interconnect 40 associated with the manifold 15 will be described with particularity. In addition, it is to be understood that the manifold 15 includes four of the filter fluid interconnects 40, one for printing each of the black, cyan, magenta and yellow pigmented ink supplies of the black and tri-color replaceable fluid containers 12. Moreover, in one preferred embodiment, each of the black, cyan, magenta and yellow printhead cartridges 16 includes a single filter fluid interconnect 40 for printing from the black, cyan, magenta and yellow pigmented ink supplies. FIG. 3 illustrates a sectional view through the black fluid container 12 and black printhead cartridge 16 only.

Figure 4:
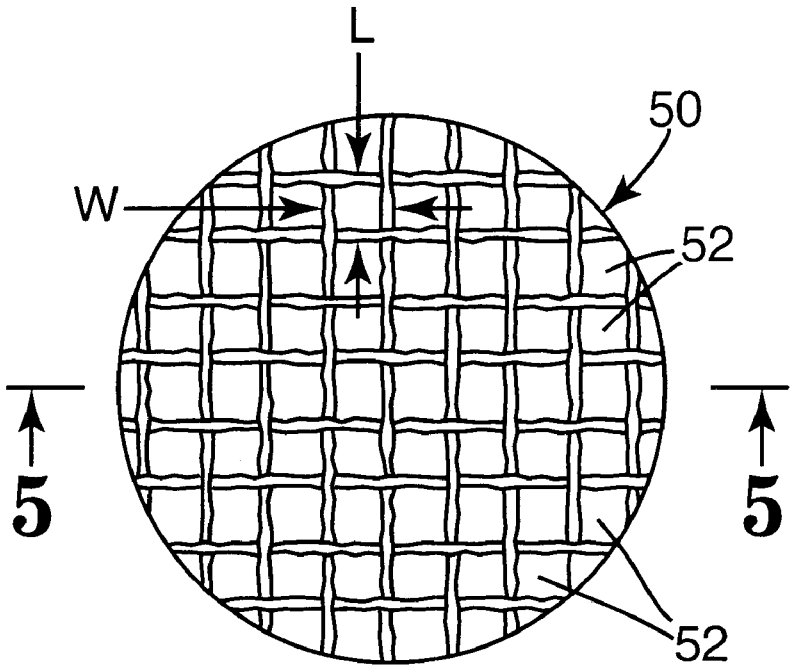
FIG. 4 is a greatly enlarged plan view of a screen filter of the filter fluid interconnect illustrated in FIG. 3.
Figure 5:
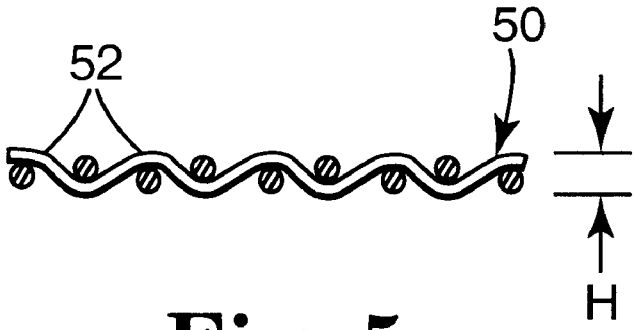
FIG. 5 is a sectional view of the screen filter taken along lines 5—5 in FIG. 4.

As seen in FIG. 3, the screen filter fluid interconnect 40 includes a cylindrical fluid delivery tower 42 having an upstream end 44 and an opposite downstream end 46. In one preferred embodiment, the tower 42 has an inside diameter of 3.5 mm. The upstream end 44 includes a peripheral ledge 48 for supporting a filter 50 (see FIG. 4) which is heat staked thereto. In one preferred embodiment, the filter 50 is an open weave screen made by weaving strands of stainless steel. As seen in FIGS. 4 and 5, the filter 50 defines a plurality of square shaped pores 52. Although square shaped pores 52 are illustrated, it is to be understood that other shapes of pores, such as circular or rectangular are also useable. Each pore 52 has a length dimension "L" and a width dimension "W". Since each pore 52 is square shaped, the length dimension "L" is equal to the width dimension "W", as such, the length dimension "L" and the width dimension "W" will simply be referred to as the edge-to-edge dimension of the pore 52 through the remainder of this description. The edge-to-edge dimension (i.e., either the length dimension "L" or the width dimension "W") of each pore 52 is at least 50 $\mu$m and less than 500 $\mu$m. More specifically, the edge-to-edge dimension of each pore 52 is at least 100 $\mu$m.

In one preferred embodiment, the edge-to-edge dimension of each pore 52 of the filter 50 of the filter fluid interconnect 40 associated with the manifold 15 is 106 $\mu$m, while the edge-to-edge dimension of each pore 52 of the filter 50 of the filter fluid interconnect 40 associated with the printhead 16 is 200 $\mu$m. The pores 52 of the filter 50 associated with the printhead 16 are larger than the pores 52 of the filter 50 associated with the manifold 15 simply to allow sufficient passage of air into the printhead 16 so as to prevent vapor lock.

As seen in FIG. 5, each pore 52 has a depth dimension "H" perpendicular to the edge-to-edge dimension. The depth dimension "H" of each pore 52 is at least 50 $\mu$m and less than 500 $\mu$m. In one preferred embodiment, the depth dimension "H" of each pore 52 of the filter 50 associated with the manifold 15 is 70 $\mu$m, while the depth dimension "H" of each pore 52 of the filter 50 associated with the printhead 16 is 170 $\mu$m. As such, each pore 52 of the filter 50 associated with the manifold 15 has a depth dimension to edge-to-edge dimension ratio of substantially 0.65, while each pore 52 of the filter 50 associated with the printhead 16 has a depth dimension to edge-to-edge dimension ratio of substantially 0.85.

Overall, the pores 52 of the filters 50 of both the manifold 15 and the printhead 16 are sized small enough to retain ink and prevent drooling when the fluid container 12 and printhead 16 are disconnected from the manifold 15. In addition, the pores 52 of the filters 50 of both the manifold 15 and the printhead 16 are sized large enough to prevent clogging of the pores 52 due to flocculation of the ink color particles (i.e., the ink color particles falling out of suspension) which may occur when the ink container 12 and printhead 16 are disconnected from the receiving station 14 and thereby manifold 15, and/or evaporation of the carrier fluid which leaves the ink color particles behind which may occur when the ink container 12, the printhead 16 and the manifold 15 remain in a sedentary state for too long.

As seen in FIG. 3, the replaceable ink container 12 includes a housing 60 defining a reservoir portion 62 for containing the supply of pigmented fluid. In particular, the reservoir portion 62 has a capillary storage member 64 disposed therein. The capillary storage member 64 is a porous member having sufficient capillarity to retain pigmented ink to prevent ink leakage from the reservoir 62 during insertion and removal of the ink container 12 from the receiving station 14 of the printing system 10. This capillary force must be sufficiently great to prevent pigmented ink leakage from the ink reservoir 62 over a wide variety of environmental conditions such as temperature and pressure changes. In addition, the capillarity of the capillary member 64 is sufficient to retain pigmented ink within the ink reservoir 62 for all orientations of the ink reservoir 62 as well as a reasonable amount of shock and vibration the ink container 12 may experience during normal handling. The preferred capillary storage member 64 is a network of heat bonded polymer fibers.

As seen in FIG. 3, the housing 60 of the replaceable ink container 12 includes a fluid outlet 66 defined by a through opening in the housing 60. A screen 68 is disposed between the capillary member 64 and the fluid outlet 66. Upon insertion of the replaceable ink container 12 into the receiving station 14, the upstream end 44 of the tower 42 of the fluid interconnect 40 of the manifold 15, which extends through an opening 63 in the receiving station 14, passes into the fluid outlet 66, bears against the screen 68 and compresses the capillary member 64, creating an area of increased capillarity in the vicinity of the upstream end 44 of the tower 42. This area of increased capillarity draws pigmented ink to the filter 50 so that the pigmented ink may pass through the pores 52 and into the tower 42 as represented by directional arrow 70. The filter 50 of the manifold 15 is compatible with pigmented ink. In particular, the pores 52 of the filter 50 of the manifold 15 are sized small enough to retain ink and prevent drooling when the fluid container 12 is disconnected from the manifold 15, and to impede bubbles and debris (particulate matter) from passing through the filter 50 and into the tower 42; and are sized large enough to prevent clogging of the pores 52 due to flocculation of the ink color particles (i.e., the ink color particles falling out of suspension) which may occur when the ink container 12 is disconnected from the receiving station 14 and thereby manifold 15, and/or evaporation of the carrier fluid, which leaves the ink color particles behind, and may occur when the ink container 12 and the manifold 15 remain in a sedentary state for too long. An elastomer fluid seal 71 surrounding the tower 42 prevents fluid leakage and impedes evaporation of the carrier fluid at the engagement interface of the fluid outlet 66 and the fluid interconnect 40.

As seen in FIG. 3, the manifold 15 includes a fluid outlet 72 defined by a through opening. The fluid outlet 72 is in fluid communication with the downstream end 46 of the tower 42 of the fluid interconnect 40 by way of a cylindrical channel 74 that extends substantially perpendicular to the tower 42. The channel 74 has an inside diameter dimension "D" greater than 1.2 mm. In one preferred embodiment, the inside diameter dimension "D" of the channel 74 is 2.0 mm. The channel 74 is sized large enough so as not to be susceptible to clogging by viscous plugs as a result of surface tension forces which cause the pigmented ink to form a liquid bridge across the inside diameter of the channel 74. The fluid outlet 72 of the manifold 15 releasably receives the fluid interconnect 40 of the printhead cartridge 16.

The fluid interconnect 40 on a housing 77 of the printhead cartridge 16 functions with the fluid outlet 72 of the manifold 15 in a similar manner as the fluid interconnect 40 of the manifold 15 functions with the fluid outlet 66 of the ink container 12. In particular, the filter 50 of the printhead 16 is compatible with pigmented ink, and the pores 52 of the filter 50 of the printhead 16 are sized small enough to retain ink and prevent drooling when the fluid container 12 is disconnected from the manifold 15, and to impede some bubbles and debris (particulate matter) from passing through the filter 50 and into the tower 42. In addition, the pores 52 of the filter 50 of the printhead 16 are sized large enough to prevent clogging of the pores 52 due to flocculation of the ink color particles (i.e., the ink color particles falling out of suspension) which may occur when the printhead 16 is disconnected from the receiving station 14 and thereby manifold 15, and/or evaporation of the carrier fluid, which leaves the ink color particles behind, and may occur when the printhead 16 and the manifold 15 remain in a sedentary state for too long.

The fluid outlet 72 of the manifold 15 includes a manifold capillary member 80. Upon engagement of the printhead cartridge 16 with the manifold 15, the tower 42 of the fluid interconnect 40 of the printhead cartridge 16 compresses the capillary member 80 creating an area of increased capillarity in the vicinity of the upstream end 44 of the tower 42. This area of increased capillarity draws pigmented ink to the filter 50 of the printhead 16 so that the pigmented ink may pass through the pores 52 and into the tower 42 and to a pressure regulator 90 of the printhead cartridge 16 as represented by directional arrow 82.

Figure 6:
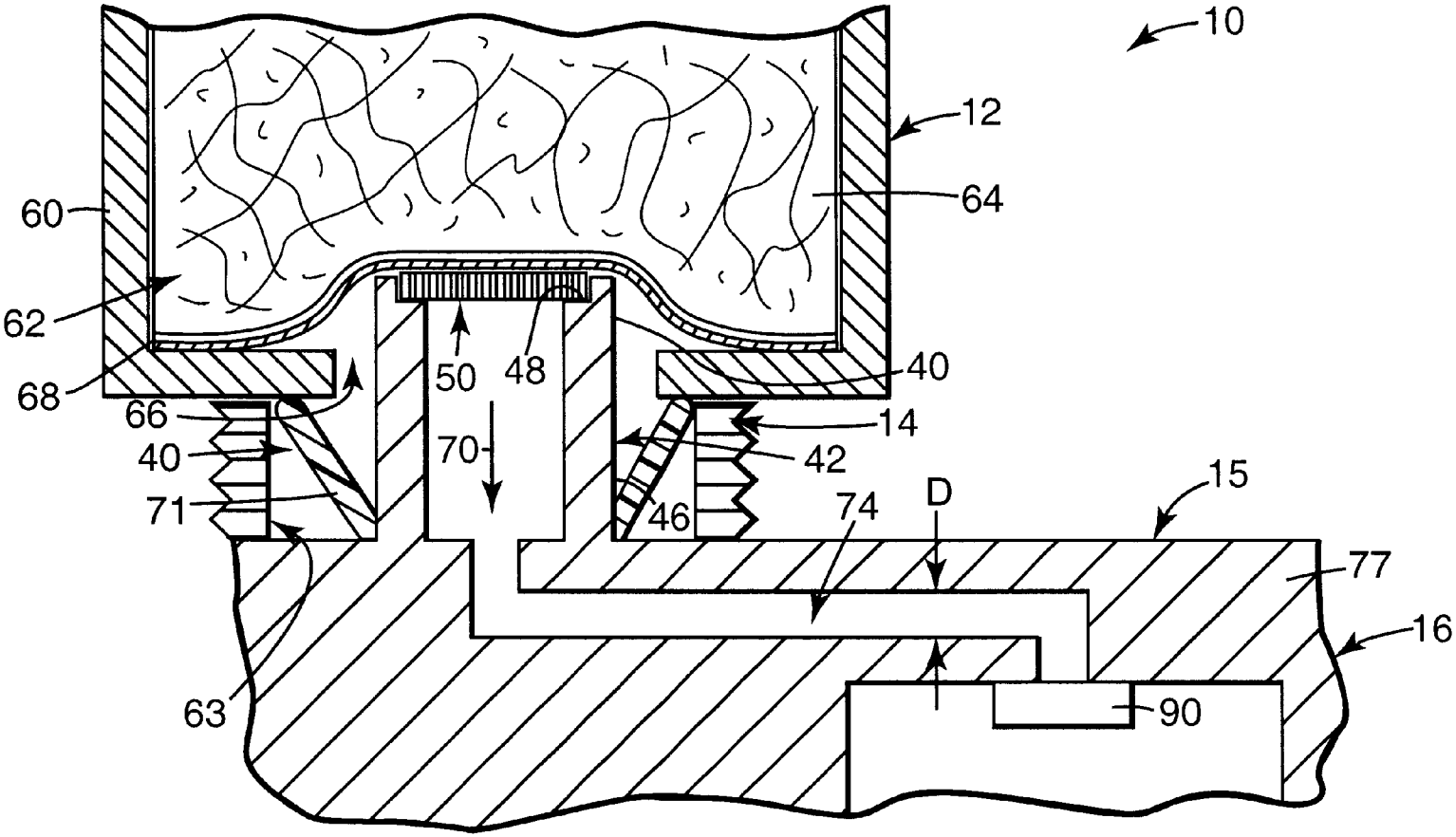
FIG. 6 is a partial sectional view illustrating an alternative embodiment wherein a replaceable ink container is fluidically coupled directly to a replaceable printhead cartridge using a filter fluid interconnect in accordance with the present invention.

FIG. 6 illustrates an alternative embodiment wherein the manifold 15 has been eliminated and the ink container 12 is directly releasably connected to the printhead cartridge 16. In this alternative embodiment, like parts are labeled with like numerals. In this alternative embodiment, the fluid interconnect 40 of the printhead cartridge 16 functions with the fluid outlet 66 of the ink container 12.

The filter/tower fluid interconnect 40 of the present invention retains ink and substantially prevents ink drooling when the ink container 12 and the printhead 16 are disconnected from the manifold 15. In addition, the filter/tower fluid interconnect 40 of the present invention is not susceptible to pigmented ink clogs caused by the ink color particles falling out of suspension (i.e., flocculation) or the carrier fluid evaporating off leaving the ink color particles behind. Moreover, the ink delivery channel 74 associated with the filter/tower fluid interconnect 40 is not susceptible to clogging caused by pigmented ink viscous plugs as a result of liquid bridging. Further, the filter/tower fluid interconnect 40 of the present invention impedes debris and air bubbles from clogging or otherwise restricting the flow of pigmented ink from an ink reservoir 62 of an ink container 12 to a print element of a printhead 16. The filter/tower fluid interconnect 40 of the present invention reliably provides these features throughout the useful life of the pigmented ink delivery system components so as to preclude premature replacement of these components and the associated cost. Lastly, the filter/tower fluid interconnect 40 of the present invention is relatively easy and inexpensive to manufacture, and relatively simple to incorporate into components used in pigmented ink delivery systems of thermal inkjet printing systems.

Although the present invention has been described with reference to preferred embodiments, workers skilled in the art will recognize that changes may be made in form and detail without departing from the spirit and scope of the invention.

What is claimed is:

1. A pigmented fluid delivery system comprising:

a first component having a fluid outlet in fluid communication with a supply of pigmented fluid defined by particles suspended in a carrier liquid; and a second component having a fluid inlet releasably connectable to the fluid outlet of the first component, the fluid inlet including a filter allowing passage of the supply of pigmented fluid while preventing clogging due to flocculation of the particles and evaporation of the carrier fluid, wherein the filter includes a plurality of pores, and wherein each pore of the plurality of pores has an edge-to-edge dimension of at least 150 $\mu$m and less than 500 $\mu$m.

2. The pigmented fluid delivery system of claim 1 wherein the edge-to-edge dimension of each pore of the plurality of pores is 200 $\mu$m.

3. The pigmented fluid delivery system of claim 1 wherein the filter includes a plurality of pores, wherein each pore of the plurality of pores has a depth dimension, and wherein the depth dimension of each pore of the plurality of pores is at least 50 $\mu$m and less than 500 $\mu$m.

4. The pigmented fluid delivery system of claim 3 wherein the depth dimension of each pore of the plurality of pores is 70 $\mu$m.

5. The pigmented fluid delivery system of claim 3 wherein the depth dimension of each pore of the plurality of pores is 170 $\mu$m.

6. The pigmented fluid delivery system of claim 3 wherein the depth dimension of each pore of the plurality of pores is 70 $\mu$m, and wherein the edge-to-edge dimension of each pore of the plurality of pores is 106 $\mu$m.

7. The pigmented fluid delivery system of claim 3 wherein the depth dimension of each pore of the plurality of pores is 170 $\mu$, and wherein the edge-to-edge dimension of each pore of the plurality of pores is 200 $\mu$m.

8. The pigmented fluid delivery system of claim 3 wherein each pore of the plurality of pores is square in shape, wherein the edge-to-edge dimension is one of a length dimension and a width dimension, and wherein the length dimension and width dimension are substantially equal.

9. The pigmented fluid delivery system of claim 1 wherein each pore of the plurality of pores has an edge-to-edge dimension, and wherein each pore of the plurality of pores has a depth dimension to edge-to-edge dimension ratio of substantially 0.65.

10. The pigmented fluid delivery system of claim 1 wherein each pore of the plurality of pores has a depth dimension perpendicular to the edge-to-edge dimension, and wherein each pore of the plurality of pores has a depth dimension to edge-to-edge dimension ratio of substantially 0.85.

11. The pigmented fluid delivery system of claim 1 wherein the filter is an open weave screen, and wherein the open weave screen defines a plurality of square shaped pores.

12. The pigmented fluid delivery system of claim 11 wherein the open weave screen is made of stainless steel.

13. The pigmented fluid delivery system of claim 1 wherein the fluid inlet of the second component includes a cylindrical fluid delivery tower having an upstream end and an opposite downstream end, and wherein the filter is located at the upstream end.

14. The pigmented fluid delivery system of claim 13 wherein the fluid inlet is further defined by a cylindrical fluid delivery channel substantially perpendicular to the tower and in fluid communication with downstream end of the tower, the channel having a diameter dimension greater than 1.2 mm.

15. The pigmented fluid delivery system of claim 14 wherein the diameter dimension of the channel is 2.0 mm.

16. The pigmented fluid delivery system of claim 1 wherein the first component is a replaceable fluid container including a reservoir containing the supply of pigmented fluid, and wherein the second component is a replaceable printhead.

17. The pigmented fluid delivery system of claim 1 wherein the first component is a replaceable fluid container including a reservoir containing the supply of pigmented fluid, and wherein the second component is a manifold adapted to removably receive the replaceable fluid container.

18. The pigmented fluid delivery system of claim 1 wherein the second component is a replaceable printhead, and wherein the first component is a manifold adapted to removably receive the replaceable printhead.

19. A pigmented fluid delivery system comprising:

a first component having a fluid outlet in fluid communication with a supply of pigmented fluid;

a second component having a fluid inlet releasably connectable to the fluid outlet of the first component, the fluid inlet including a filter compatible with the supply of pigmented fluid, wherein the second component further includes a fluid outlet in fluid communication with the fluid inlet; and a third component having a fluid inlet releasably connectable to the fluid outlet of the second component, the fluid inlet of the third component including a filter compatible with the supply of pigmented fluid;

wherein the filter of the second component and the filter of the third component each include a plurality of pores, and wherein each pore of the plurality of pores has an edge-to-edge dimension of at least 150 $\mu$m and less than 500 $\mu$m.

20. The pigmented fluid delivery system of claim 19 wherein the first component is a replaceable fluid container including a reservoir containing the supply of pigmented fluid, wherein the second component is a manifold adapted to removably receive the replaceable fluid container, and wherein the third component is a replaceable printhead adapted to be removably received by the manifold.

21. A fluid interconnect comprising:

a tower member adapted to be connectable to a supply of pigmented fluid defined by particles suspended in a carrier liquid; and a screen mounted to the tower member, the screen defaming a plurality of pores sized to allow passage of pigmented fluid from the supply of pigmented fluid, and sized so as to prevent clogging due to flocculation of the particles and evaporation of the carrier liquid, wherein each pore of the plurality of pores has a edge-to-edge dimension, and wherein the edge-to-edge dimension is at least 150 μm and less than 500 μm.

22. The fluid interconnect of claim 21 wherein each pore of the plurality of pores has a depth dimension perpendicular to the edge-to-edge dimension, and wherein the depth dimension of each pore of the plurality of pores is at least 50 μm and less than 500 μm.

23. The fluid interconnect of claim 22 wherein the depth dimension of each pore of the plurality of pores is 170 μm, and wherein the edge-to-edge dimension of each pore of the plurality of pores is 200 μm.

24. The fluid interconnect of claim 22 wherein the depth dimension of each pore of the plurality of pores is 70 μm, and wherein the edge-to-edge dimension of each pore of the plurality of pores is 106 μm.

25. The fluid interconnect of claim 21 and further including:

a fluid delivery channel substantially perpendicular to the tower and in fluid communication with the tower, the channel having an edge-to-edge dimension greater than 1.2 mm.

26. The fluid interconnect of claim 25 wherein the edge-to-edge dimension of the channel is 2.0 mm.

27. A printer component comprising:

a housing including:

a fluid inlet releasably connectable to a supply of pigmented fluid defined by particles suspended in a carrier liquid, the fluid inlet including a filter defining a plurality of pores sized to allow passage of pigmented fluid from the supply of pigmented fluid, and sized so as to prevent clogging due to flocculation of the particles and evaporation of the carrier liquid, wherein each pore of the plurality of of pores has a edge-to-edge dimension, and wherein the edge-to-edge dimension is at least 150 μm and less than 500 μm.

28. The printer component of claim 27 wherein the printer component is a replaceable printer component.

29. The printer component of claim 28 wherein the replaceable printer component is a printhead.

30. The printer component of claim 27 wherein the printer component is a manifold adapted to removable receive a replaceable fluid container.

* * * * *